US006791475B2

(12) United States Patent
Yamashita

(10) Patent No.: US 6,791,475 B2
(45) Date of Patent: Sep. 14, 2004

(54) NON-STOP TOLL COLLECTION METHOD AND SYSTEM

(75) Inventor: Hiroshi Yamashita, Tokyo (JP)

(73) Assignee: NEC Corporation, Tokyo (JP)

( * ) Notice: Subject to any disclaimer, the term of this patent is extended or adjusted under 35 U.S.C. 154(b) by 75 days.

(21) Appl. No.: 10/109,849

(22) Filed: Apr. 1, 2002

(65) Prior Publication Data

US 2002/0145542 A1 Oct. 10, 2002

(30) Foreign Application Priority Data

Apr. 4, 2001 (JP) ..... 2001-106317

(51) Int. Cl.[7] ..... G08G 1/01

(52) U.S. Cl. ..... 340/935; 340/928; 340/933; 235/384; 342/107; 342/113; 342/147; 701/117

(58) Field of Search ..... 340/935, 928, 340/933, 942, 988, 934, 937; 235/384, 375, 380, 381, 492; 701/117, 216; 180/167, 169; 705/417; 342/104, 105, 107, 113, 147, 457, 42, 43, 44

(56) References Cited

U.S. PATENT DOCUMENTS

| | | | | |
|---|---|---|---|---|
| 4,493,103 A | * | 1/1985 | Yamashita et al. | 382/104 |
| 5,686,906 A | * | 11/1997 | Ono et al. | 340/928 |
| 5,864,306 A | | 1/1999 | Dwyer et al. | |
| 5,864,831 A | | 1/1999 | Schuessler | |
| 5,933,096 A | * | 8/1999 | Tsuda | 340/928 |
| 5,969,641 A | * | 10/1999 | Nakamura et al. | 340/928 |
| 6,042,008 A | | 3/2000 | Ando et al. | |
| 6,138,912 A | * | 10/2000 | Mitsuno | 235/384 |
| 6,411,889 B1 | * | 6/2002 | Mizunuma et al. | 701/117 |
| 6,477,260 B1 | * | 11/2002 | Shimomura | 382/106 |
| 6,646,590 B2 | * | 11/2003 | Terashima et al. | 340/905 |

FOREIGN PATENT DOCUMENTS

| | | |
|---|---|---|
| DE | 44 22 418 A1 | 2/1996 |
| JP | 8-69598 | 3/1996 |

OTHER PUBLICATIONS

Association of Radio Industries and Business, "Electrical Toll Collection System", Dec. 1999. Revision 1.2, ARIB STD–155.

* cited by examiner

*Primary Examiner*—Davetta W. Goins
(74) *Attorney, Agent, or Firm*—Young & Thompson

(57) ABSTRACT

A plurality of roadside wireless devices are provided on a roadside of an entry of a toll area. A first roadside wireless device, which communicates with a vehicle-mounted device over wireless communication, sends unique information obtained from the vehicle-mounted device to a second roadside wireless device located, downstream to the first roadside wireless device, along a moving direction of the vehicle. The second roadside wireless device checks if unique information on the vehicle-mounted device obtained from the vehicle-mounted device matches the unique information on vehicle-mounted device notified from the first roadside wireless device to judge if the moving direction is a direction of entry into a toll area and charges the vehicle-mounted device for toll only when it is judged that the moving direction is the direction of entry into the toll area.

20 Claims, 5 Drawing Sheets

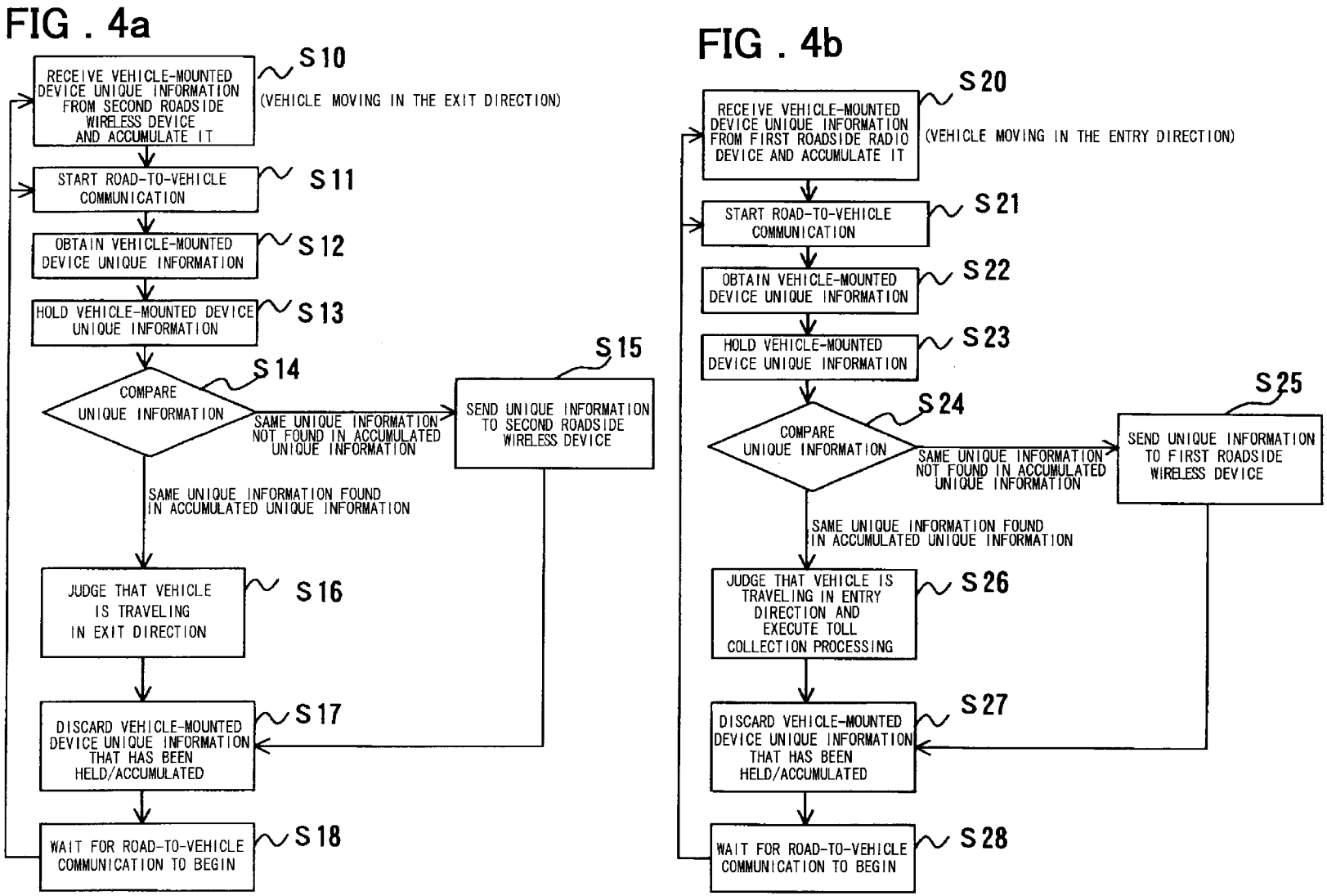
FIG. 4a
S10
(VEHICLE MOVING IN THE EXIT DIRECTION)
RECEIVE VEHICLE-MOUNTED DEVICE UNIQUE INFORMATION FROM SECOND ROADSIDE WIRELESS DEVICE AND ACCUMULATE IT
S11
START ROAD-TO-VEHICLE COMMUNICATION
S12
OBTAIN VEHICLE-MOUNTED DEVICE UNIQUE INFORMATION
S13
HOLD VEHICLE-MOUNTED DEVICE UNIQUE INFORMATION
S14
COMPARE UNIQUE INFORMATION
SAME UNIQUE INFORMATION NOT FOUND IN ACCUMULATED UNIQUE INFORMATION
S15
SEND UNIQUE INFORMATION TO SECOND ROADSIDE WIRELESS DEVICE
SAME UNIQUE INFORMATION FOUND IN ACCUMULATED UNIQUE INFORMATION
S16
JUDGE THAT VEHICLE IS TRAVELING IN EXIT DIRECTION
S17
DISCARD VEHICLE-MOUNTED DEVICE UNIQUE INFORMATION THAT HAS BEEN HELD/ACCUMULATED
S18
WAIT FOR ROAD-TO-VEHICLE COMMUNICATION TO BEGIN
FIG. 4b
S20
(VEHICLE MOVING IN THE ENTRY DIRECTION)
RECEIVE VEHICLE-MOUNTED DEVICE UNIQUE INFORMATION FROM FIRST ROADSIDE RADIO DEVICE AND ACCUMULATE IT
S21
START ROAD-TO-VEHICLE COMMUNICATION
S22
OBTAIN VEHICLE-MOUNTED DEVICE UNIQUE INFORMATION
S23
HOLD VEHICLE-MOUNTED DEVICE UNIQUE INFORMATION
S24
COMPARE UNIQUE INFORMATION
SAME UNIQUE INFORMATION NOT FOUND IN ACCUMULATED UNIQUE INFORMATION
S25
SEND UNIQUE INFORMATION TO FIRST ROADSIDE WIRELESS DEVICE
SAME UNIQUE INFORMATION FOUND IN ACCUMULATED UNIQUE INFORMATION
S26
JUDGE THAT VEHICLE IS TRAVELING IN ENTRY DIRECTION AND EXECUTE TOLL COLLECTION PROCESSING
S27
DISCARD VEHICLE-MOUNTED DEVICE UNIQUE INFORMATION THAT HAS BEEN HELD/ACCUMULATED
S28
WAIT FOR ROAD-TO-VEHICLE COMMUNICATION TO BEGIN

EXAMPLE OF DATA SENT BY ROADSIDE RADIO DEVICE

NON-STOP TOLL COLLECTION METHOD AND SYSTEM

FIELD OF THE INVENTION

The present invention relates generally to a non-stop electrical toll collection system which is one of Intelligent Transport Systems (ITS), and more particularly to a system and a method that may be advantageously applied to toll collection from a vehicle-mounted device.

BACKGROUND OF THE INVENTION

Recently, a non-stop electrical toll collection system is used in which a roadside device antenna (base station antenna) installed in a toll lane on a toll road such as an express way conduct communication via a wireless link with a vehicle-mounted device (mobile station) provided on a vehicle to send toll charging information to the vehicle-mounted device at an entry or exit location. On the vehicle-mounted device that has received toll information, the toll collection is executed by taking off the toll using an electronic account settlement technique with an IC card and the like connected to the vehicle-mounted device. This system allows a vehicle to electronically pay a toll without having to stop at the tollbooth. A vehicle-mounted device for use in the Electrical Toll Collection (ETC) system, which is commercially available, is mounted for example on a dashboard in the vehicle.

The toll collection technique for use on a vehicle-mounted device in the non-stop electrical toll collection system will be described below with a conventional uniform-toll entry-location collection system in which a vehicle-mounted device is charged for a uniform-toll at an entry location of an express road as an example.

Road-to-vehicle communication between a roadside wireless device (base station) and a vehicle-mounted device functioning as a mobile station is made via control signal sent from the roadside wireless device.

As the vehicle-mounted device approaches the entry tollbooth of a toll road and enters a narrow wireless communication area of the roadside wireless device, the vehicle-mounted device receives the control signal sent from the roadside wireless device.

FIG. 5 illustrates an example of the format of data continuously sent from the roadside wireless device and the format of data sent from the vehicle-mounted device. The diagram in FIG. 5 is created in the present specification based on the description in page 41 in "(Draft) Electrical Toll Collection System" issued by Association of Radio Industries and Business, December 1999, Revision 1.2, ARIB STD-T55). FIG. 5 shows an example of the format of down-link, that is, data sent from base station (roadside wireless device) and the format of up-link, that is, data sent from mobile station (vehicle-mounted device).

Referring to FIG. 5, the data is composed of frames, each of which is made up of a plurality of slots. The first control signal, termed an "Na" slot, of a frame contains control information 10 on the mobile station (vehicle-mounted device). The Na slot contains a guard time, a preamble (PR) for carrier and clock synchronization, a unique word (UW1), control information and an error check code (CRC).

The Na slot, termed a frame control message slot (FCMS), is a slot for frame-multiplexing. One such frame is provided at the start of each frame only for down-link. This slot is used by the base station as a communication control slot to send Frame Control Message Channel (FCMC) composed of frame control information and TDMA slot allocation information. The control information, which will be outlined below, consists of the following fields (not shown in the FIGURE); 2-octets transmission channel control field SIG (Signaling) for layer-1 channel configuration information and so on, 1-octet frame configuration information field FSI (Frame Structure Information), 1-octet release timer information field RLT (Release Timer information), 7-octets base station service application information field SC (Service Code), and slot control information field SCI (Slot Control Identifier) for communication slot allocation. The SCI includes MDS (Message Data Slot) allocation information comprised of a 1-octet control information sub-field CI (Control Information) and a 4-octets link address field LID (Link ID).

The Nb and Nc slots are message data slots (MDS) which are slots for multiplexing data. One or more (m number of slots) such slots are allocated following the FCMS in one frame. Message data slots (MDS) are multiplexed by the base station in down-link, and by the mobile station in up-link. The number of SCIs is m for the half-duplex mode, and 2 m for the full-duplex mode. In the frame configuration for full-duplex communication, a part of message data slots (MDS) for up-link channels are commonly used for activation slots (ACTS). The attribute of a slot is determined by control information multiplexed into the FCMS.

When road-to-vehicle communication is not conducted, the roadside wireless device composing the base station, sends only Na slots. Nb and Nc slots are empty slots.

As the vehicle-mounted device composing a mobile station, enters the wireless communication area, the vehicle-mounted device first detects the unique word (UW1) 9(*n*) included in the Na slot of the signal sent from the roadside wireless device and makes the time slot of the vehicle-mounted device synchronize with the roadside wireless device.

Then, the vehicle-mounted device receives the control information 10(*n*) that follows the unique word (UW1) 9(*n*) and checks for a data error using the error check code (CRC) 11(*n*). If no error is detected as a result of error checking, the vehicle-mounted device analyzes the contents of the control information 10(*n*) and sends the activation channel, that is wireless link connection request signal, ACTC (Activation Channel) 15(*n*) to the roadside wireless device using time slots that are available for the vehicle-mounted device for transmission. An activation slot (ACTS) is used only for up-link. There are allocated six channels of windows for the activation channels used for the mobile station to register to the communication link of the base station. In the link establishment phase, the vehicle-mounted device composing a mobile station, selects one of the windows to transmit the ACTC to the base station.

In response to the ACTC 15(*n*) from the vehicle-mounted device, the roadside wireless device notifies the reception time slots of the vehicle-mounted device using the control information 10(*n*+1) in the (N+1) a slot (not shown) and sends data to the vehicle-mounted device using the (N+1) b slot or the (N+1) c slot.

The control information 10(*n*+1) includes information on:

type of roadside wireless device, link address field LID (Link ID) information on vehicle-mounted device and the like When the vehicle-mounted device has successfully received data arranged in the (N+1) b slot or (N+1) c slot, it analyzes the contents of data and sends back response data using the transmission time slot indicated by the frame control message slot (FCMS) sent from the roadside wireless device.

The data 14(*n*) in the Nb slot or the Nc slot includes detailed information regarding the toll collection, being transferred between the roadside wireless device and the vehicle-mounted device. The toll collection is performed normally by transferring this data.

The conventional toll charging processing system described above operates normally when the roadside wireless device is provided at a limited location, that is, at a tollbooth at the entry of a toll road and the like.

However, if this system is applied to a general public road and to a toll collection system that charges a vehicle entering a toll collection area for a toll, the problem is that an erroneous charging to the vehicle may occur.

That is, in a public road of two-way traffics, especially in a lane having a narrow width and a face to face traffic, unlike a one way tollbooth lane at an entry of a toll road, a vehicle exiting a toll collection area must also pass through the wireless communication area of the roadside wireless device.

As a result, the vehicle-mounted device executes road-to-vehicle communication with the roadside wireless device and is charged for the toll even when exiting the toll collection area. Thus, an erroneous charging occurs unless some toll collection protection is devised.

Japanese Patent Kokai Publication JP-A-8-69598 proposes a toll collection system that controls toll collection according to the direction in which a vehicle travels. This system charges a vehicle that traveling in the forward direction lane but does not charge a vehicle traveling in the opposite lane. A first antenna and a second antenna are provided near a tollbooth along the lanes to allow the tollbooth to communicate with vehicle-mounted devices for collecting tolls in non-contact mode. The first antenna and the second antenna each send information including a unique antenna number. The vehicle-mounted device receives the signals from the first antenna and the second antenna and checks the antenna numbers to determine which communication area the vehicle-mounted device has entered first. When traveling in the opposite lane, the backward-traveling flag is turned on to disable toll collection. The vehicle-mounted device uses a timer to measure the time during which the backward-traveling flag remains on and when a predetermined time has passed or the vehicle enters the communication area of a tollbooth antenna emitting different location information, clears the backward-traveling flag to enable communication. In this toll collection system, the vehicle-mounted device judges the moving direction based on information sent from the antenna and when the backward-traveling flag is on, does not collect the toll. However, the system with this configuration gives a vehicle-mounted device user a chance to evade tolls by altering the backward-direction traveling flag, for example, by turning it on.

SUMMARY OF THE DISCLOSURE

Accordingly, it is an object of the present invention to provide a method and a system, for use in a toll collection system that charges uniform toll at a tollbooth in a toll road, that can correctly perform toll charging, via road-to-vehicle communication, only to vehicles traveling in the direction for which toll must be charged, without having to stop a vehicle.

As will become apparent from the description below, the present invention may be applied not only to a toll collection system but also to various systems in a base station that manages mobile stations.

The above and other objects of the invention are satisfied, at least in part, by providing a system including a plurality of base stations which are coupled for communication each other, in which on base station of the base stations obtains unique information on a mobile station that has entered a wireless communication range of the one base station via wireless communication with the mobile station; and notifies the unique information on the mobile station, obtained by the one of base stations, to other base station located downstream to the one base station along a moving direction of the mobile station, and in which the other base station obtains unique information on the mobile station via wireless communication with the mobile station that has entered a wireless communication range of the other base station; determines if a moving direction of the mobile station is a predetermined forward direction or a backward direction by comparing the unique information on the mobile station obtained by the other base station with the unique information notified by the one base station; and controls an execution of predetermined processing for the mobile station based on a determination result of the moving direction of the mobile station.

The system in accordance with another aspect of the present invention has a plurality of roadside wireless devices. One roadside wireless device communicating with a vehicle-mounted device on a vehicle via wireless communication notifies unique information, obtained from the vehicle-mounted device via road-to-vehicle communication, to other roadside wireless device located downstream to the one roadside wireless device, along a moving direction of the vehicle. The other roadside wireless device determines if a moving direction of the vehicle is an entry into or exit from the toll area by comparing unique information obtained from the vehicle-mounted device via road-to-vehicle communication with the unique information notified by the one roadside wireless device and based on a result of the determination, controls an execution of toll charging processing.

A method for managing a mobile station in accordance with a further aspect of the present invention uses a plurality of base stations coupled for communicating each other and comprises the steps of:

obtaining, by one base station, unique information on a mobile station that has entered a wireless communication range of said one base station, via wireless communication with the mobile station;

notifying, by one base station, the unique information on the mobile station obtained by said one base station, to other base station located downstream to said one base station along a moving direction of the mobile station;

obtaining, by said other base station, unique information on the mobile station via wireless communication with the mobile station that has entered a wireless communication range of said other base station;

determining, by said other base station, if a moving direction of the mobile station is a predetermined forward direction or a backward direction by comparing the unique information on the mobile station obtained by said other base station with the unique information notified by said one of base stations; and controlling, by said other base station, an execution of predetermined processing for the mobile station based on a determination result of the moving direction of the mobile station.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 4 is a flowchart of the processing procedures for a first roadside wireless device and a second roadside wireless device in one embodiment of the present invention.

PREFERRED EMBODIMENTS OF THE INVENTION

Figure 1:
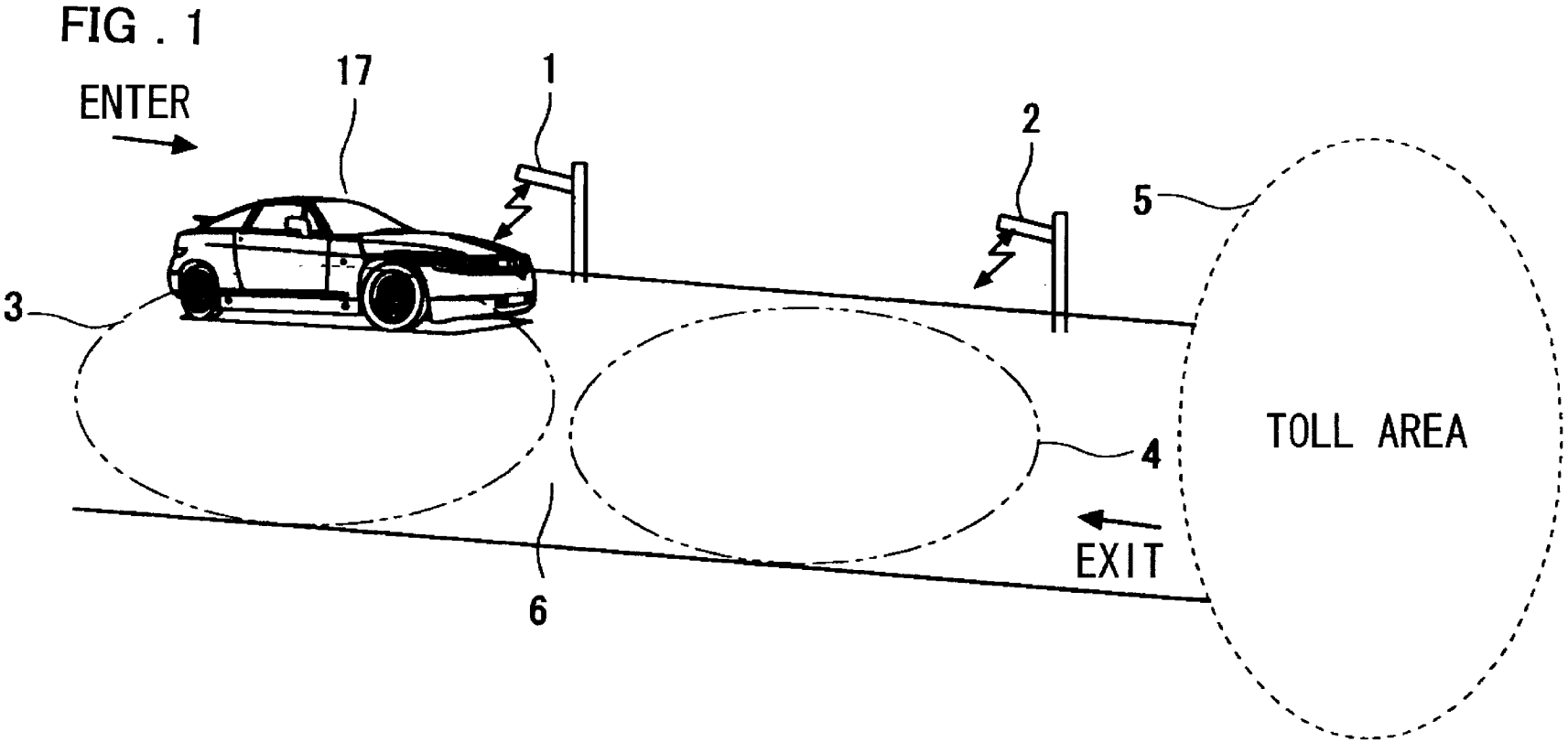
FIG. 1 is a diagram showing the configuration of the system in one embodiment of the present invention.

An embodiment of the present invention will be described. The configuration of the embodiment of the present invention is that at least two sets of roadside wireless devices are provided instead of one set as in a conventional system, that a roadside wireless device has an additional function that accumulates history information indicating a vehicle-mounted device with which road-to-vehicle communication was made based on the unique information stored in the vehicle-mounted device, and that this history information is shared between the two sets of roadside wireless devices described above.

A first roadside wireless device located upstream viewed from a vehicle entering a toll area notifies unique information, obtained from the vehicle-mounted device, to a second roadside wireless device arranged downstream to the first roadside wireless device viewed from the vehicle.

The second roadside wireless device judges the moving direction of the vehicle based on the notified unique information on the vehicle-mounted device and only when necessary, performs a charging operation.

In the embodiment of the present invention, at least the first and the second roadside wireless devices (1, 2 in FIG. 1), each of which composes a base station respectively, are provided, for example at a tollbooth on a toll road, along a road leading to a toll area. The first and the second wireless communication areas (3, 4 in FIG. 1) of the first and the second roadside wireless devices are provided such that they do not overlap. The vehicle-mounted device (mobile station) mounted on a vehicle (17 in FIG. 1) entering the toll area (5 in FIG. 1) enters the first wireless communication area (3 in FIG. 1) located upstream along a vehicle moving direction, communicates with the first roadside wireless device (1 in FIG. 1) over a wireless communication link. The first roadside wireless device (1 in FIG. 1) obtains the vehicle-mounted device unique information sent from the vehicle-mounted device over a wireless communication link.

The first roadside wireless device (1) sends the vehicle-mounted device unique information to the second roadside wireless device (2 in FIG. 1) located downstream along the vehicle moving direction, and then the first roadside wireless device discards (deletes) the vehicle-mounted device unique information.

The second roadside wireless device (2) accumulates the vehicle-mounted device unique information, sent from the first roadside wireless device (1), into the storage means. As the vehicle (17) goes on moving to enter the second wireless communication area (4), the second roadside wireless device (2) obtains vehicle-mounted device unique information from the vehicle-mounted device and retrieves the vehicle-mounted device unique information already stored in the storage means to check whether there exists the vehicle-mounted device unique information that matches the obtained vehicle-mounted device unique information or not.

If the vehicle-mounted device unique information matching the obtained vehicle-mounted device unique information is present in the storage means, the second roadside wireless device (2) executes toll charging processing for the vehicle-mounted device, judging that the vehicle (17) is going to enter the toll area (5). After executing toll charging processing for the vehicle-mounted device, the second roadside wireless device (2) deletes the vehicle-mounted device unique information of the vehicle-mounted device from the storage means.

On the other hand, when the vehicle-mounted device of a vehicle exiting the toll area (5) enters the second wireless communication area (4) located upstream along the vehicle moving direction, it communicates with the second roadside wireless device (2). The second roadside wireless device (2) obtains vehicle-mounted device unique information sent from the vehicle-mounted device. The second roadside wireless device (2) sends the vehicle-mounted device unique information to the first roadside wireless device (1) located downstream along the moving direction and compares the vehicle-mounted device unique information with vehicle-mounted device unique information being stored in the storage means. If the vehicle-mounted device unique information matching the obtained vehicle-mounted device unique information is not stored in the storage means, the second roadside wireless device (2) does not execute toll charging processing for the vehicle-mounted device.

The first roadside wireless device (1) stores the vehicle-mounted device unique information, sent from the second roadside wireless device (2), into the storage means. As the vehicle goes on traveling and enters the first wireless communication area (3), the first roadside wireless device (1) obtains vehicle-mounted device unique information sent from the vehicle-mounted device and retrieves the accumulated vehicle-mounted device unique information for matching information.

If the vehicle-mounted device unique information matching the obtained vehicle-mounted device unique information is present in the storage means, the first roadside wireless device (1) does not execute toll charging processing for the vehicle-mounted device, judging that the vehicle is exiting the toll area. The first roadside wireless device (1) discards the obtained vehicle-mounted device unique information and the vehicle-mounted device unique information that matched the obtained vehicle-mounted device unique information and is being stored in the storage means.

The embodiment of the present invention will be described more in detail with reference to the drawings. FIG.

1 is a diagram showing one embodiment of the present invention. In a system for collecting a uniform-toll at an entry, a vehicle 17 to be charged executes road-to-vehicle communication first with a first roadside wireless device 1 in the forward position, and then with a second roadside wireless device 2 downstream along the vehicle moving direction. In FIG. 1, the reference numeral 5 designates a toll area (for example, toll road), the reference numeral 6 designates a tollbooth entry road to the toll area 5, the reference numerals 3 and 4 designates wireless communication areas of the first roadside wireless device 1 and the second roadside wireless device 2, respectively. The narrow wireless communication area 3 of the first roadside wireless device 1 and the narrow wireless communication area 4 of the second roadside wireless device 2, which do not overlap, are arranged in series along the road. The toll area 5, where vehicles are tolled at an entry, is not limited to a toll road; the toll area may be any places such as a toll parking lot, a meeting place, and so on. In addition, although the wireless communication areas 3 and 4 of the first and second roadside wireless devices 1 and 2 are shown as areas each corresponding to the length of one vehicle, they may be areas long enough to include several or more vehicles.

Figure 2:
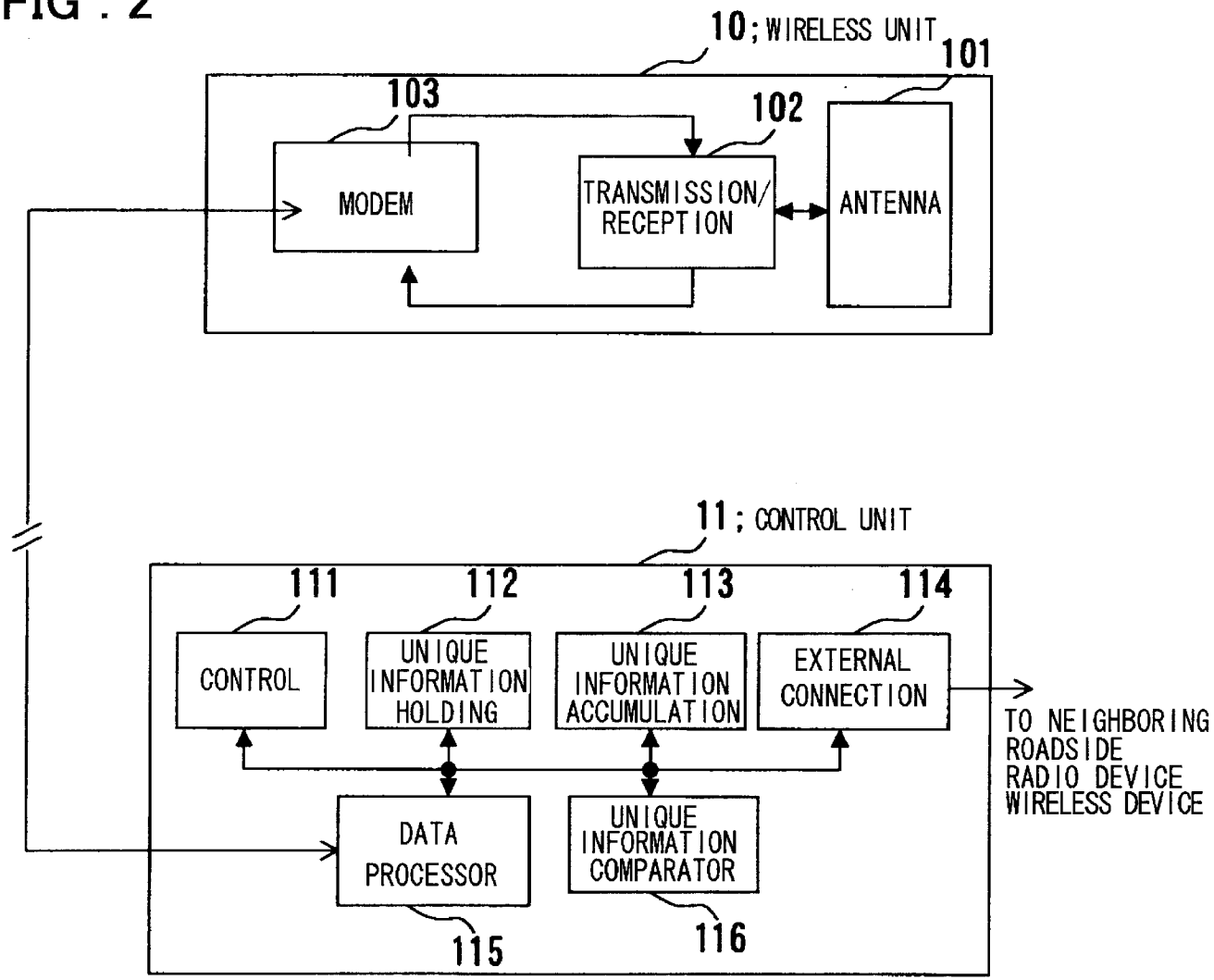
FIG. 2 is a diagram showing the configuration of a roadside wireless device in one embodiment of the present invention.

FIG. 2 is a diagram showing an example of the configuration of the roadside wireless device 1 in one embodiment of the present invention. Referring to FIG. 2, the roadside wireless device 1 comprises a wireless unit 10 and a control unit 11 which is connected to the wireless unit 10. The wireless unit 10 mounted, for example, on the top of the roadside wireless device 1 shown in FIG. 1 comprises an antenna 101, a transmission/reception unit 102 comprised of a transmission circuit, a reception circuit, and a signal separator (switching unit), and a modem 103. The control unit 11 comprises a control circuit 111 that controls the general operation of the control unit 11, a unique information holding unit 112, a unique information accumulation unit 113, an external connection unit 114, a data processor (signal processor) 115, and a unique information comparator 116. The data processor 115 extracts the unique information of the vehicle-mounted device from the demodulated data output from the modem 103 of the wireless unit 10, and the extracted unique information of the vehicle-mounted device is held in the unique information holding unit 112. The unique information comparator 116 compares the unique information in the unique information holding unit 112 with the unique information accumulated in the unique information accumulation unit 113. The external connection unit 114 sends the obtained unique information (unique information in the unique information holding unit 112) to the neighboring roadside wireless device under control of the control circuit 111. The antenna 101, which is constituted of microstrip antenna devices or is an array antenna having a plurality of antenna devices and the like, forms the beam of the roadside wireless device into a desired shape to transmit a transmission/reception beam with a higher directivity. The transmission power of the roadside wireless device is determined properly according to the wireless communication area size, the surrounding circumstances and the like.

Figure 3:
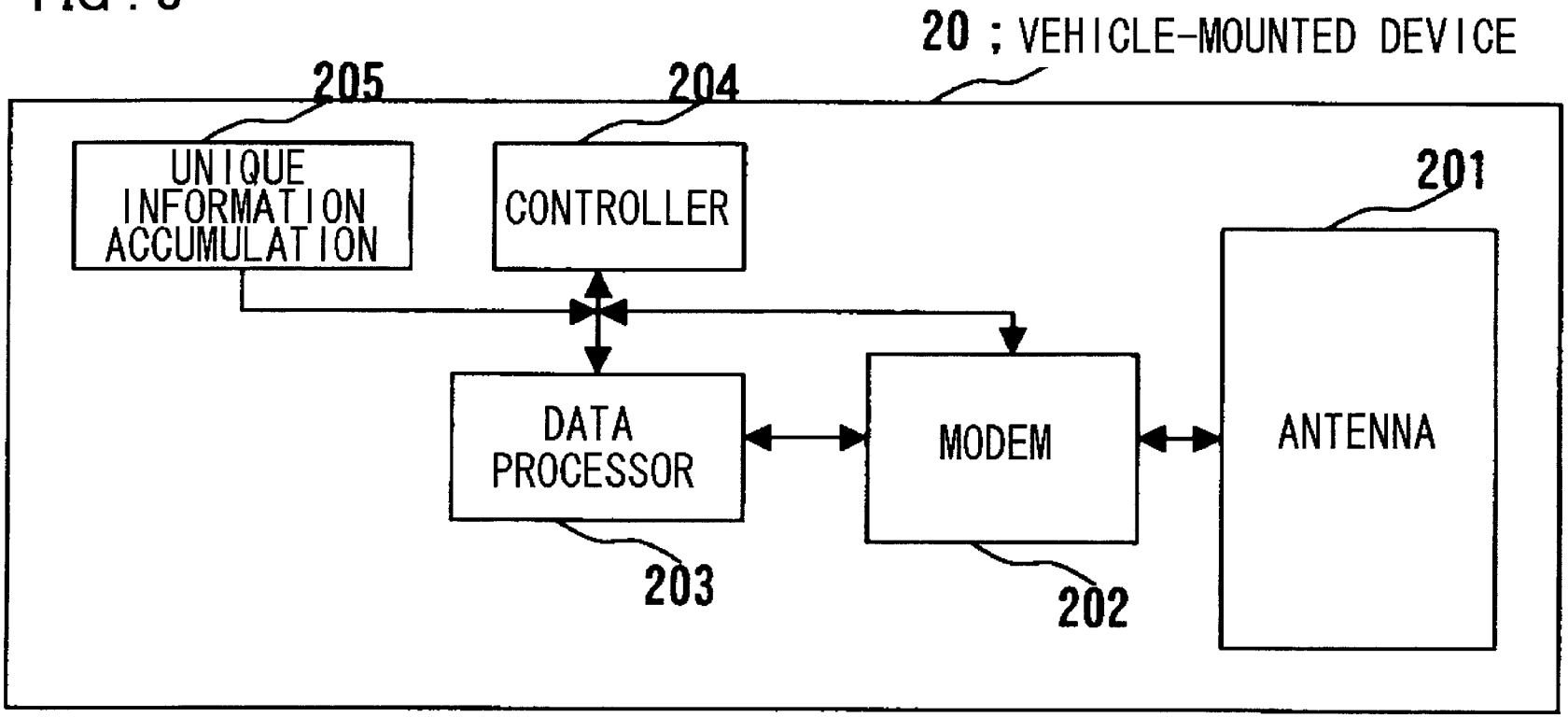
FIG. 3 is a diagram showing the configuration of a vehicle-mounted device in one embodiment of the present invention.

FIG. 3 is a diagram showing an example of the vehicle-mounted device in the embodiment according to the present invention. Referring to FIG. 3, the vehicle-mounted device comprises an antenna 201, a transmission/reception unit (not shown), a modem 202, a data processor (signal processor) 203, a controller (CPU) 204 that controls the whole device, and a unique information accumulation unit 205. The controller 204 generates a random number, for example, when the engine is started, generates a link address LID (Link ID) comprised of 4-octet (28 bits in practice) binary data, and accumulates it in the unique information accumulation unit 205 as the unique information (identification data) on the vehicle-mounted device. Although the manufacture number (manufacture number+serial number) may be used as the unique information on the vehicle-mounted device, the link address LID is usually used as the unique information on the vehicle-mounted device to protect privacy. The vehicle-mounted device, which has an IC card connection unit (not shown) connected to the controller 204, has information read from or written to the IC card by the controller 204. In this embodiment, an off-the-shelf ETC vehicle-mounted device may be used as the vehicle-mounted device.

Figure 5:
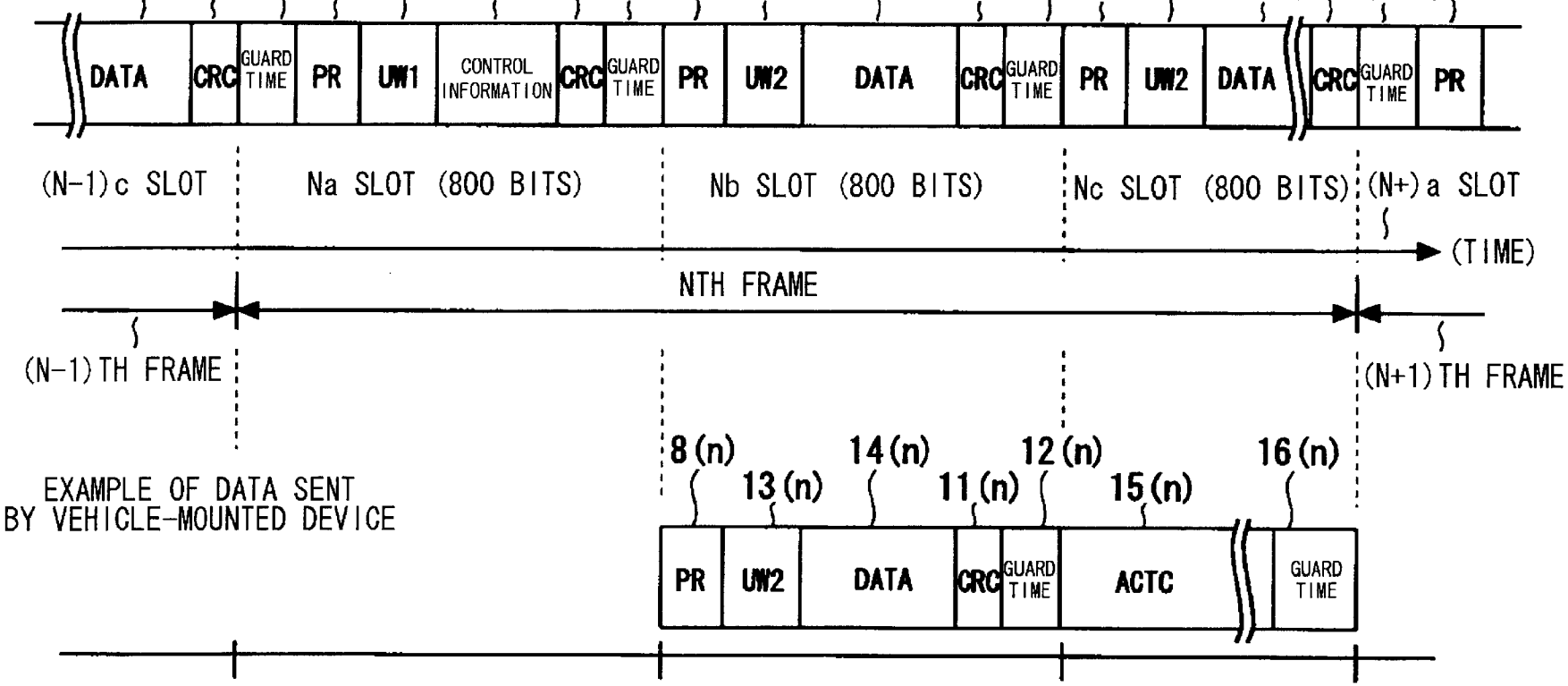
FIG. 5 is a diagram showing the format of data sent from the roadside wireless device and the vehicle-mounted device.

An example of the operation in this embodiment will be described with reference to FIG. 1 and FIG. 5.

When the vehicle 17 enters the wireless communication area 3, the vehicle-mounted device (not shown) on the vehicle receives the control information 10(*n*) of a frame control message slot (FCMS) (see FIG. 5) from the first roadside wireless device 1, as described in the conventional technique and starts road-to-vehicle communication. In response, the vehicle-mounted device (not shown) sends the communication request signal using the activation slot (ACTS).

In the case as shown in FIG. 1, the first and second roadside wireless devices 1 and 2 are arranged in series. The first roadside wireless device 1 is arranged upstream along the moving direction of the vehicle to be charged, and the second roadside wireless device 2 is arranged downstream.

When the road-to-vehicle communication is started, the first roadside wireless device 1 receives the activation channel ACTC 15(*n*) (FIG. 5) from the vehicle-mounted device. The data in the activation channel ACTC 15(*n*) includes the vehicle-mounted device unique information (L1) (LID). When wireless communication is completed normally, the first roadside wireless device 1 sends the vehicle-mounted device unique information (L1) to the second roadside wireless device 2 and discards the vehicle-mounted device unique information (L1) from the device. The vehicle-mounted device unique information (L1) may be transmitted from the first roadside wireless device 1 to the second roadside wireless device 2 via a cable or wireless transmissions.

On the other hand, the second roadside wireless device 2 accumulates the vehicle-mounted device unique information (L1 information), sent from the first roadside wireless device 1.

Then, as the vehicle keeps on traveling and enters the wireless communication area 4, the second roadside wireless device 2 obtains the vehicle-mounted device unique information (L2) from the data in the ACTC 15(*n*) sent from the vehicle-mounted device.

In the second roadside wireless device 2, the vehicle-mounted device unique information (L1) being stored matches the obtained vehicle-mounted device unique information (L2) because they are the unique information from the same vehicle-mounted device.

That is, the second roadside wireless device 2 checks if the unique information, which matches the vehicle-mounted device unique information (L2) obtained from the vehicle-mounted device, is present in the vehicle-mounted device unique information that is notified from the first roadside wireless device 1 and stored in the unique information accumulation unit 113 of the second roadside wireless device 2 (see FIG. 2). If the same unique information is present as a result of checking, the second roadside wireless device 2 keeps on wireless communication and executes toll charging processing for the vehicle-mounted device. After the toll collection is performed for the vehicle-mounted device normally, the second roadside wireless device 2 discards the vehicle-mounted device unique information (L1, L2) stored in the second roadside wireless device 2. That is, the second roadside wireless device 2 deletes the vehicle-mounted device unique information (L1, L2) from the unique information accumulation unit 113 and the unique information holding unit 112 (see FIG. 2).

On the other hand, a vehicle that exits the toll area 5 travels in the lane opposite to the lane in the entry direction and enters the second wireless communication area 4 first. When the road-to-vehicle communication begins, the second roadside wireless device 2 in the forward direction of the vehicle obtains the vehicle-mounted device unique information (L2) from the data in the activation channel ACTC 15(*n*) sent from the vehicle-mounted device and sends it to the first roadside wireless device 1 and discards the vehicle-mounted device unique information (L2).

At this time, the second roadside wireless device 2 checks if the vehicle-mounted device unique information (L2) is present in the plurality of units of accumulated vehicle-mounted device unique information. In this case, because the vehicle has not yet entered the wireless communication area 3 and the vehicle-mounted device unique information has not yet been sent from the first roadside wireless device 1, the same unique information as the vehicle-mounted device unique information (L2) is not in the unique information accumulation unit 113 (see FIG. 2) of the second roadside wireless device 2. Therefore, the second roadside wireless device 2 does not execute toll charging processing for the vehicle-mounted device.

As the vehicle keeps on traveling and enters the wireless communication area 3, the first roadside wireless device 1 obtains the unique information (L1) from the data stored in the activation channel ACTC 15(*n*) sent from the vehicle-mounted device via wireless communications.

The first roadside wireless device 1 checks if the same unique information as the unique information (L1) is included in the vehicle-mounted device unique information accumulated in the unique information accumulation unit 113 (see FIG. 2) of the first roadside wireless device 1. If the same unique information is present, the first roadside wireless device 1 discards L1 and L2. If the same unique information is present, the first roadside wireless device 1 judges that the vehicle is traveling in the exit direction and does not execute toll charging processing for the vehicle-mounted device.

In this embodiment, with the operation described above, it is made possible to collect a toll only from a vehicle entering the toll area 5.

FIG. 4*a* and FIG. 4*b* are flowcharts showing the processing procedures for the first roadside wireless device 1 and the second roadside wireless device 2 described above. The processing procedures for the first roadside wireless device 1 and the second roadside wireless device 2 will be described with reference to FIGS. 1–4.

First, referring to FIG. 4*a*, on receipt of the vehicle-mounted device unique information sent from the second roadside wireless device 2, the first roadside wireless device 1 stores the vehicle-mounted device unique information in the unique information accumulation unit 113 (see FIG. 2) (step S10). In the first roadside wireless device 1, this processing step is executed when the vehicle is traveling in the direction in which the vehicle exits the toll area 5.

The first roadside wireless device 1 starts road-to-vehicle communication with the vehicle-mounted device of the vehicle 17 entering the wireless communication area 3, obtains the vehicle-mounted device unique information, and holds the obtained vehicle-mounted device unique information in the unique information holding unit 112 (see FIG. 2) (steps S11–S13).

Then, the first roadside wireless device 1 retrieves the vehicle-mounted device unique information stored in the unique information accumulation unit 113 to check if the same unique information as the obtained vehicle-mounted device unique information is present (step S14). If the same unique information is not present (judges that the vehicle is traveling in entry direction), the first roadside wireless device 1 sends the obtained vehicle-mounted device unique information from the external connection unit 114 to the second roadside wireless device 2 (step S15), discards the vehicle-mounted device unique information that has been held (step S17), and waits for the road-to-vehicle wireless communication (step S18).

If it is found that the same unique information is present in the unique information accumulation unit 113 as a result of checking in step S14, the first roadside wireless device 1 judges that the vehicle is traveling in the exit direction (step S16), discards the vehicle-mounted device unique information held in the unique information holding unit 112 and the vehicle-mounted device unique information stored in the unique information accumulation unit 113 (same unique information as the vehicle-mounted device unique information held in the unique information holding unit 112) (step S17), and waits for the road-to-vehicle wireless communication (step S18). If, during this wait period in step S18, communication with the vehicle-mounted device of the vehicle 17 that has entered the wireless communication area 3 begins, the processing starts from step S11. If vehicle-mounted device unique information is received from the second roadside wireless device 2, the processing starts from step S10.

Referring to FIG. 4*b*, on receipt of the vehicle-mounted device unique information sent from the first roadside wireless device 1, the second roadside wireless device 2 stores the vehicle-mounted device unique information in the unique information accumulation unit 113 (see FIG. 2) (step S20). In the second roadside wireless device 2, this processing step is executed when the vehicle is traveling in the direction in which the vehicle enters the toll area 5.

The second roadside wireless device 2 starts road-to-vehicle communication with the vehicle-mounted device of the vehicle 17 entering the wireless communication area 4, obtains the vehicle-mounted device unique information, and holds the obtained vehicle-mounted device unique information in the unique information holding unit 112 (see FIG. 2) (steps S21–S23).

Then, the second roadside wireless device 2 retrieves the vehicle-mounted device unique information stored in the unique information accumulation unit 113 (see FIG. 2) to check if the same unique information as the obtained vehicle-mounted device unique information is present (step S24). If the same unique information is not present (judges that the vehicle is traveling in exit direction), the second roadside wireless device 2 sends the obtained vehicle-mounted device unique information from the external connection unit 114 to the first roadside wireless device 1 (step S25), discards the vehicle-mounted device unique information that has been held (step S27), and waits for the road-to-vehicle wireless communication (step S28).

If it is found that the same unique information is present in the unique information accumulation unit 113 as a result of checking in step S24, the second roadside wireless device 2 judges that the vehicle is traveling in the entry direction (step S26), discards the vehicle-mounted device unique information held in the unique information holding unit 112 and the vehicle-mounted device unique information accumulated in the unique information accumulation unit 113 (same unique information as the vehicle-mounted device unique information held in the unique information holding unit 112) (step S27), and waits for the road-to-vehicle wireless communication (step S28). If, during this wait period in step S28, communication with the vehicle-mounted device of the vehicle 17 that has entered the wireless communication area 4 begins, the processing starts from step S21. If the second roadside wireless device 2 receives the vehicle-mounted device unique information sent from the first roadside wireless device 1, the processing starts from step S20.

Although toll charging processing is executed by two roadside wireless devices, that is, first roadside wireless device 1 and second roadside wireless device 2, in the above embodiment, it is possible to install more roadside wireless devices if the amount of detailed data associated with toll charging processing is so large that it requires a long road-to-vehicle communication time.

In the above embodiment, each of the wireless communication areas 3 and 4 of the first and second roadside wireless devices 1 and 2 may be large enough to include a plurality of vehicles. In this case, the vehicle-mounted devices of a plurality of vehicles send data to the roadside wireless device (base station) using the time slots available for each vehicle-mounted device.

The present invention is not limited to restricted installation environments such as a tollbooth on a toll road but may be used to collect tolls from vehicle-mounted devices on a public road without stopping vehicles.

The system to which the present invention is applied is not limited to an electrical toll collection (ETC) system used by a tollbooth at an entry of a flat-fare toll road but may be applied to an electrical toll collection (ETC) system used by a tollbooth at an exit of a flat-fare toll road. In this case, a toll is not collected from a vehicle (vehicle-mounted device) entering the toll road but from a vehicle (vehicle-mounted device) exiting the toll road. In addition, the system according to the present invention may be configured, for use in a road pricing system in which tolls are collected from vehicles entering from non-Metropolitan areas into the Metropolitan area, such that at least two sets of roadside wireless devices are installed at predetermined locations on freeways or main national roads to collect tolls from the vehicles entering the Metropolitan area.

In addition, the present invention may be applied to a non-stop parking-fee collection system at a toll parking lot. For example, the system allows the traffic into the parking lot of an amusement part or a theme park to flow smoothly to avoid traffic congestion at the entry of the parking lot. Furthermore, the present invention may be applied to a non-stop payment system in a gas station, convenience store, or drive-through shop. In this case, there is no need to use cash to pay for merchandise at a store. For example, at a location between the merchandize order location and an exit, the roadside wireless device according to the present invention charges an IC card inserted into the vehicle-mounted device. In this case, a vehicle entering from the exit is judged by the first and second base stations (roadside wireless devices) as a vehicle moving in the opposite direction and therefore this vehicle is not charged.

In addition, the present invention may be applied to a direction guide system for blind persons installed in a station yard or in a home. Communication between a wireless terminal (mobile station) carried by a blind person and a plurality of base stations arranged in one direction enables the base stations to obtain unique information on the mobile station and to determine the direction into which the mobile station is moving. For example, when a person moves into the forward direction, the system notifies that he or she may keep on moving; on the other hand, when a person who is entering a place that is prohibited to enter or is moving in the direction opposite to the desired direction, the system sounds an alarm to alert him or her to the condition.

The system may also be adapted such that a control station or a management center is provided that is connected to both the first and the second base stations. In this configuration, when the first base station receives a unique information from a mobile station, it sends the received unique information to the control station or the management center. After that, when the second base station located downstream to the first base station, along the moving direction of the mobile station, receives a unique information from the mobile station, it sends the unique information to the control station or the center that is in an upper layer than that of the base station. The control station or the management center compares the unique information received from the second base station with the unique information sent previously from the first base station and stored in the control station or the management center to check the moving direction of the mobile station, and according to the checking result, issues a processing execution instruction for the mobile station via the second base station.

The meritorious effects of the present invention are summarized as follows.

As described above, the system and method according to the present invention make it possible to collect tolls correctly via road-to-vehicle communication, without stopping the vehicles, only from vehicles moving in the direction in which tolls are required. The system and method according to the present invention also make it possible to execute an appropriate processing which corresponds to the moving direction of the mobile station.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A mobile station management system including a plurality of base stations coupled for communication each other, wherein one base station of said plurality of base stations comprises:

means for obtaining unique information on a mobile station that has entered a wireless communication area of said one base station, via wireless communication with the mobile station; and means for notifying the unique information on the mobile station obtained by said one base station to another base station located downstream to said one base station along a moving direction of the mobile station, and wherein said another base station comprises:

means for obtaining unique information on the mobile station via wireless communication with the mobile station that has entered a wireless communication area of said another base station;

means for determining if the moving direction of the mobile station is a predetermined forward direction or a backward direction by comparing the unique information on the mobile station obtained by said another base station with the unique information notified by said one of base stations; and means for controlling an execution of predetermined processing for the mobile station based on a determination result of the moving direction of the mobile station.

2. The mobile station management system as defined in claim 1, wherein in case of the moving direction of the mobile station being a predetermined one direction of the forward and backward directions, said means for controlling an execution of predetermined processing based on the determination result of the moving direction of the mobile station executes first processing necessary in association with the movement along said one direction of the mobile station, and in case of the moving direction of the mobile station being an opposite direction of said predetermined one direction, does not execute said first processing respectively.

3. The mobile station management system as defined in claim 2, wherein in case of the moving direction of the mobile station being the opposite of said predetermined one direction, said means for controlling an execution of predetermined processing based on the determination result of the moving direction of the mobile station does not execute said first processing but executes predetermined second processing associated with the movement of the mobile station along said opposite direction.

4. The mobile station management system as defined in claim 1, wherein the mobile station is a wireless communication device provided in or mounted on a mobile body.

5. The mobile station management system as defined in claim 1, wherein said mobile station is a vehicle-mounted device for ETC (Electrical Toll Collection) that is mounted on a vehicle.

6. A toll collection system comprising a plurality of roadside wireless devices being spaced each other and arranged along a road leading to a toll area, wherein a first roadside wireless device communicating with a vehicle-mounted device on a vehicle via wireless communication comprises:

means for notifying unique information obtained by said first roadside wireless device from said vehicle-mounted device via road-to-vehicle communication to a second roadside wireless device located downstream to said one roadside wireless device along a moving direction of the vehicle, and wherein said second roadside wireless device comprises:

means for determining if a moving direction of the vehicle is an entry into or exit from said toll area by comparing unique information obtained by said second roadside wireless device from said vehicle-mounted device via road-to-vehicle communication with the unique information notified by said second roadside wireless device from said first roadside wireless devices, and for controlling an execution of toll charging processing based on a result of the determination.

7. A toll collection system comprising at least a first and a second roadside wireless devices that are spaced each other and arranged along a road leading to a toll area, wireless communication areas of said first and second roadside wireless devices not overlapping, wherein a vehicle-mounted device mounted on a vehicle entering the toll area communicates with said first roadside wireless device located upstream along a moving direction of the vehicle, wherein said first roadside wireless device comprises means for obtaining vehicle-mounted device unique information sent from said vehicle-mounted device via wireless communication and for notifying the vehicle-mounted device unique information to the second roadside wireless device located downstream along the moving direction of the vehicle, and wherein said second roadside wireless device comprises:

means for storing the vehicle-mounted device unique information notified by said first roadside wireless device into storage means;

means for obtaining vehicle-mounted device unique information sent from said vehicle-mounted device via wireless communication and for retrieving the vehicle-mounted device unique information, stored in said storage means to check if vehicle-mounted device unique information matching the obtained vehicle-mounted device unique information is present;

means for executing toll charging processing for said vehicle-mounted device judging that the vehicle is entering the toll area if vehicle-mounted device unique information matching the obtained vehicle-mounted device unique information is present in said storage means; and means for deleting the vehicle-mounted device unique information on said vehicle-mounted device stored in said storage means after executing the toll charging processing for said vehicle-mounted device.

8. The toll collection system as defined in claim 7, wherein a vehicle-mounted device of the vehicle moving in a direction of an exit from the toll area communicates, via wireless communication, with said second roadside wireless device located upstream along a moving direction of the vehicle, wherein said second roadside wireless device further comprises means for obtaining vehicle-mounted device unique information sent from said vehicle-mounted device via wireless communication and for notifying the vehicle-mounted device unique information to said first roadside wireless device located downstream to said second roadside wireless device along the moving direction of the vehicle, wherein said second roadside wireless device obtains vehicle-mounted device unique information sent from said vehicle-mounted device via wireless communication, retrieves vehicle-mounted device unique information stored in said storage means to check if vehicle-mounted device unique information matching the obtained vehicle-mounted device unique information is present in said storage means, said second roadside wireless device not executing toll charging processing for said vehicle-mounted device, if vehicle-mounted device unique information matching the obtained vehicle-mounted device unique information is not present in said storage means, and wherein said first roadside wireless device further comprises:

means for storing the vehicle-mounted device unique information notified by said second roadside wireless device into storage means;

means for obtaining vehicle-mounted device unique information sent from said vehicle-mounted device via wireless communication and for retrieving the vehicle-mounted device unique information, stored in said storage means, to check if vehicle-mounted device unique information matching the obtained vehicle-mounted device unique information is present; and means for controlling to suppress toll charging processing for said vehicle-mounted device judging that the vehicle is moving in a direction of an exit from the toll area if vehicle-mounted device unique information matching the obtained vehicle-mounted device unique information is present in said storage means.

9. A method for managing a mobile station by using a plurality of base stations coupled for communicating each other, said method comprising the steps of:

obtaining, by one base station, unique information on a mobile station that has entered a wireless communication range of said one base station, via wireless communication with the mobile station;

notifying, by one base station, the unique information on the mobile station obtained by said one base station, to another base station located downstream to said one base station along a moving direction of the mobile station;

obtaining, by said another base station, unique information on the mobile station via wireless communication with the mobile station that has entered a wireless communication range of said other base station;

determining, by said another base station, if a moving direction of the mobile station is a predetermined forward direction or a backward direction by comparing the unique information on the mobile station obtained by said another base station with the unique information notified by said one of base stations; and controlling, by said another base station, an execution of predetermined processing for the mobile station based on a determination result of the moving direction of the mobile station.

10. The mobile method as defined in claim 9, wherein if the moving direction of the mobile station is a predetermined one direction of the forward direction and a backward direction of the mobile station, the step of controlling an execution of predetermined processing based on a determination result of the moving direction of the mobile station executes first processing necessary in association with the movement into said one direction of the mobile station and, if the moving direction of the mobile station is an opposite direction of said one direction of the mobile station, does not execute said first processing.

11. The method as defined in claim 10, wherein if the moving direction of the mobile station is the opposite of said one directions of the mobile station, the step of controlling an execution of predetermined processing based on a determination result of the moving direction of the mobile station does not execute the first processing but executes predetermined second processing with regards to the movement along said opposite direction.

12. The method as defined in claim 9, wherein the mobile station is a wireless device provided in or mounted on a moving body.

13. The method as defined in claim 9, wherein said mobile station is a vehicle-mounted device for ETC (Electrical Toll Collection) that is mounted on a vehicle.

14. A method for managing a mobile station, said method comprising the steps of:

obtaining, by one base station which communicates with a mobile station via a wireless communication, unique information on the mobile station via the wireless communication with the mobile station;

notifying, by said one base station, the unique information on the mobile station obtained by said one of base stations, to a control station or a center connected to said one of base stations;

obtaining, by another base station located downstream to said one base station along a moving direction of the mobile station, unique information on the mobile station via wireless communication with the mobile station that has entered a wireless communication range of said another base station;

notifying, by said another base station, the unique information on the mobile station obtained by said another base station, to said control station or center connected to said another base station, comparing, by said control station or center, the unique information on the mobile station obtained by said another base station with the unique information notified by said one of base stations to determine if a moving direction of the mobile station is a predetermined forward direction or a backward direction by; and controlling, by said another base station, an execution of predetermined processing for the mobile station via said another base station based on a determination result of the moving direction of the mobile station.

15. A toll collection method in which a plurality of roadside wireless devices are spaced each other and arranged along a road leading to a toll area, said method comprising the steps of:

notifying, by one roadside wireless device which communicates with a vehicle-mounted device on a vehicle via wireless communication, unique information obtained from said vehicle-mounted device via road-to-vehicle communication, to other roadside wireless device located downstream to said one roadside wireless device along a moving direction of the vehicle; and comparing, by said other roadside wireless device, unique information obtained from said vehicle-mounted device via road-to-vehicle communication with the unique information notified by said one roadside wireless device to determine if a moving direction of the vehicle is an entry into or exit from the toll area for controlling an execution of toll charging processing based on a determination result.

16. A toll collection method in which at least a first and a second roadside wireless devices are spaced each other and arranged along a road leading to a toll area, first and second wireless communication areas of said first and second roadside wireless devices not overlapping, said method comprising the steps of:

obtaining, by said first roadside wireless device, vehicle-mounted device unique information sent from a vehicle-mounted device via wireless communication when said vehicle-mounted device mounted on a vehicle entering the toll area enters the first wireless communication area located upstream along a moving direction of the vehicle and communicates with said first roadside wireless device via wireless communication;

notifying, by said first roadside wireless device, the vehicle-mounted device unique information to said second roadside wireless device located downstream along the moving direction and then discarding the vehicle-mounted device unique information;

storing, by said second roadside wireless device, the vehicle-mounted device unique information notified by said first roadside wireless device into storage means;

obtaining, by said second roadside wireless device, vehicle-mounted device unique information sent from said vehicle-mounted device via wireless communication when the vehicle enters the second wireless communication area;

retrieving, by said second roadside wireless device, the vehicle-mounted device unique information, stored in said storage means to check if vehicle-mounted device unique information matching the obtained vehicle-mounted device unique information is present;

executing, by said second roadside wireless device, toll charging processing for said vehicle-mounted device judging that the vehicle is entering the toll area if vehicle-mounted device unique information matching the obtained vehicle-mounted device unique information is present in said storage means; and deleting, by said second roadside wireless device, the vehicle-mounted device unique information on said vehicle-mounted device from said storage means after executing the toll charging processing for said vehicle-mounted device.

17. The toll collection method as defined in claim 16 further comprising the steps of:

a vehicle-mounted device of a vehicle moving along a direction of an exit from the toll area entering the second wireless communication area located upstream along a moving direction of the vehicle to communicate with said second roadside wireless device via wireless communication, obtaining, by said second roadside wireless device, vehicle-mounted device unique information sent from said vehicle-mounted device;

notifying, by said second roadside wireless device, the vehicle-mounted device unique information to said first roadside wireless device located downstream along the moving direction of the vehicle;

obtaining, by said second roadside wireless device, vehicle-mounted device unique information sent from said vehicle-mounted device via wireless communication, retrieving the vehicle-mounted device unique information, stored in said storage means, to check if vehicle-mounted device unique information matching the obtained vehicle-mounted device unique information is present in said storage means, and suppressing toll charging processing for said vehicle-mounted device if the vehicle-mounted device unique information matching the obtained vehicle-mounted device unique information is not present in said storage means;

storing, by said first roadside wireless device, the vehicle-mounted device unique information notified by said second roadside wireless device into storage means;

obtaining, by said first roadside wireless device, vehicle-mounted device unique information sent from said vehicle-mounted device via wireless communication when the vehicle keeps on moving and enters the first wireless communication area, and retrieving the vehicle-mounted device unique information, stored in said storage means, to check if vehicle-mounted device unique information matching the obtained vehicle-mounted device unique information;

suppressing, by said first roadside wireless device, toll charging processing for said vehicle-mounted device judging that the vehicle is moving in the direction of an exit from the toll area if the vehicle-mounted device unique information matching the obtained vehicle-mounted device unique information is present in said storage means; and deleting, by said first roadside wireless device, the obtained vehicle-mounted device unique information and the vehicle-mounted device unique information stored in said storage means matching the obtained vehicle-mounted device unique information.

18. The system of claim 1, wherein the plural base stations have non-overlapping wireless communications areas.

19. The system of claim 6, wherein said first roadside wireless device communicates with the vehicle-mounted device in a first time period and said second roadside wireless device communicates with said vehicle mounted device in a second time period, the first and second time periods being non-overlapping.

20. The method of claim 9, wherein said one and said another base station communicate with the vehicle at different non-overlapping time periods.

* * * * *